US007901297B2

(12) United States Patent
Ban et al.

(10) Patent No.: US 7,901,297 B2
(45) Date of Patent: Mar. 8, 2011

(54) GOLF CLUB HEAD

(75) Inventors: Wataru Ban, Chichibu (JP); Fumiaki Sato, Chichibu (JP); Kozue Wada, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 143 days.

(21) Appl. No.: 12/355,344

(22) Filed: Jan. 16, 2009

(65) Prior Publication Data

US 2010/0087270 A1 Apr. 8, 2010

(30) Foreign Application Priority Data

Oct. 8, 2008 (JP) ..... 2008-262060

(51) Int. Cl.
*A63B 53/04* (2006.01)

(52) U.S. Cl. ..... 473/331

(58) Field of Classification Search ..... 473/330–331
See application file for complete search history.

(56) References Cited

U.S. PATENT DOCUMENTS

| | | | |
|---|---|---|---|
| 1,965,954 | A | 7/1934 | Davis |
| 5,437,088 | A | 8/1995 | Igarashi |
| 5,709,616 | A | 1/1998 | Rife |
| 2008/0020859 | A1 | 1/2008 | Yamagishi et al. |
| 2008/0125242 | A1 | 5/2008 | Ban |
| 2008/0125243 | A1 | 5/2008 | Ban |
| 2008/0132351 | A1 | 6/2008 | Ban |
| 2008/0132352 | A1 | 6/2008 | Ban |
| 2009/0176597 | A1 | 7/2009 | Yamagishi et al. |

FOREIGN PATENT DOCUMENTS

| | | | |
|---|---|---|---|
| JP | 8-777 | A | 1/1996 |
| JP | 8-229169 | A | 9/1996 |
| JP | 9-70457 | A | 3/1997 |
| JP | 9-253250 | A | 9/1997 |
| JP | 2008-23178 | A | 2/2008 |
| JP | 2008-132168 | A | 6/2008 |
| JP | 2008-132169 | A | 6/2008 |
| JP | 2008-136619 | A | 6/2008 |
| JP | 2008-136833 | A | 6/2008 |

*Primary Examiner*—Stephen L. Blau
(74) *Attorney, Agent, or Firm*—Paul, Hastings, Janofsky & Walker LLP

(57) ABSTRACT

This invention provides a golf club head including a plurality of score lines on the face. The golf club head includes a plurality of striations formed on the face and extending from a toe side to a heel side. A depth Dp of each striation satisfies 10 μm≦Dp≦40 μm. A cross-sectional shape of each striation is an isosceles trapezoid having an upper base at the face side and a lower base at the back side of the golf club head. The upper base and lower base satisfy the upper base>the lower base. A width Pb of the bottom portion of each protrusion formed between the striations and a width Wb of the lower base satisfy Pb<Wb.

6 Claims, 8 Drawing Sheets

FIG. 8

| | SHAPE OF STRIATION | Wb/Pb | Wb (μm) | Pb (μm) | Pu (μm) | θ (°) | Dp (μm) | P (μm) | SURFACE ROUGHNESS (Ra) | SPIN AMOUNT | DEGREE OF CLOGGING | RULE CONFORM-ANCE |
|---|---|---|---|---|---|---|---|---|---|---|---|---|
| #1 | RECTANGULAR | 1.5 | 180 | 120 | 120 | – | 15 | 300 | 7.25 | A | D | × |
| #2 | ISOSCELES TRAPEZOID | 0.7 | 120 | 180 | 10 | 160 | 15 | 300 | 4.62 | B | C | × |
| #3 | ISOSCELES TRAPEZOID | 0.7 | 163 | 237 | 10 | 160 | 20 | 400 | 6.32 | D | D | × |
| #4 | ISOSCELES TRAPEZOID | 0.8 | 23 | 27 | 10 | 60 | 15 | 50 | 5.56 | D | D | × |
| #11 | ISOSCELES TRAPEZOID | 1.5 | 178 | 122 | 10 | 150 | 15 | 300 | 4.23 | B | A | ○ |
| #12 | ISOSCELES TRAPEZOID | 5.3 | 252 | 48 | 0 | 100 | 20 | 300 | 2.82 | A | B | ○ |
| #13 | ISOSCELES TRAPEZOID | 4.2 | 242 | 58 | 10 | 100 | 20 | 300 | 3.58 | B | B | ○ |
| #14 | ISOSCELES TRAPEZOID | 3.8 | 237 | 63 | 15 | 100 | 20 | 300 | 4.17 | B | B | ○ |
| #15 | ISOSCELES TRAPEZOID | 18.3 | 379 | 21 | 10 | 30 | 20 | 400 | 1.50 | A | A | ○ |
| #16 | ISOSCELES TRAPEZOID | 7.0 | 350 | 50 | 10 | 90 | 20 | 400 | 2.67 | A | A | ○ |
| #17 | ISOSCELES TRAPEZOID | 4.0 | 321 | 79 | 10 | 120 | 20 | 400 | 3.55 | B | A | ○ |
| #18 | ISOSCELES TRAPEZOID | 2.3 | 280 | 120 | 10 | 140 | 20 | 400 | 4.52 | C | B | ○ |
| #19 | ISOSCELES TRAPEZOID | 17.3 | 378 | 22 | 10 | 100 | 5 | 400 | 0.45 | D | C | ○ |
| #20 | ISOSCELES TRAPEZOID | 5.9 | 342 | 58 | 10 | 100 | 20 | 400 | 2.78 | B | B | ○ |
| #21 | ISOSCELES TRAPEZOID | 2.8 | 295 | 105 | 10 | 100 | 40 | 400 | 8.52 | A | A | × |
| #22 | ISOSCELES TRAPEZOID | 2.7 | 73 | 27 | 10 | 60 | 15 | 100 | 4.13 | A | C | ○ |
| #23 | ISOSCELES TRAPEZOID | 10.0 | 273 | 27 | 10 | 60 | 15 | 300 | 2.89 | A | B | ○ |
| #24 | ISOSCELES TRAPEZOID | 21.0 | 573 | 27 | 10 | 60 | 15 | 600 | 0.88 | B | A | ○ |

GOLF CLUB HEAD

BACKGROUND OF THE INVENTION

1. Field of the Invention

The present invention relates to a golf club head.

2. Description of the Related Art

Generally, on the face of a golf club head, a plurality of straight grooves are formed parallel to each other in the toe-and-heel direction. These grooves are called score lines, marking lines, face lines, or the like (to be referred to as score lines in this specification). These score lines have an effect of increasing the backspin amount of a shot or suppressing a significant decrease in the backspin amount of a shot in the case of a rainy day or a shot from the rough.

However, the amount of increase in the backspin amount of a shot obtained by changing the design of score lines is limited. To solve this problem, Japanese Patent Laid-Open Nos. 9-253250, 2008-23178, 2008-132168, 2008-132169, 2008-136619, and 2008-136833 each disclose an iron golf club head in which striations are formed on the face by milling in addition to score lines. Also, Japanese Patent Laid-Open No. 8-229169 discloses a patter head in which striations are formed on the face by milling.

Like the golf club heads disclosed in Japanese Patent Laid-Open Nos. 9-253250, 2008-23178, 2008-132168, 2008-132169, 2008-136619, and 2008-136833, forming striations on the face in addition to score lines can increase the backspin amount of a shot. However, the striations may clog with fine pieces of grass or the like. In this case, the backspin amount of a shot may become unsteady.

SUMMARY OF THE INVENTION

It is an object of the present invention to provide a golf club head which can provide a higher backspin amount more steadily.

According to the present invention, there is provided a golf club head including a plurality of score lines on a face, comprising a plurality of striations formed on said face and extending from a toe side to a heel side, wherein a depth Dp of each striation satisfies $10\ \mu m \leqq D \leqq 40\ \mu m$, a cross-sectional shape of each striation is a isosceles trapezoid having an upper base at the face side and a lower base at a back side of the golf club head, the upper base and lower base satisfy the upper base>the lower base, and a width Pb of each protrusion formed between the striations and a width Wb of the lower base satisfies Pb<Wb.

Further features of the present invention will become apparent from the following description of exemplary embodiments (with reference to the attached drawings).

BRIEF DESCRIPTION OF THE DRAWINGS

FIG. 8 is a table showing the specifications of striations of golf club heads #1 to #4 and #11 to #24, the evaluation results of the backspin amounts and degrees of clogging of striations, and the rule conformance associated with the surface roughness of the face.

DESCRIPTION OF THE EMBODIMENTS

Figure 1:
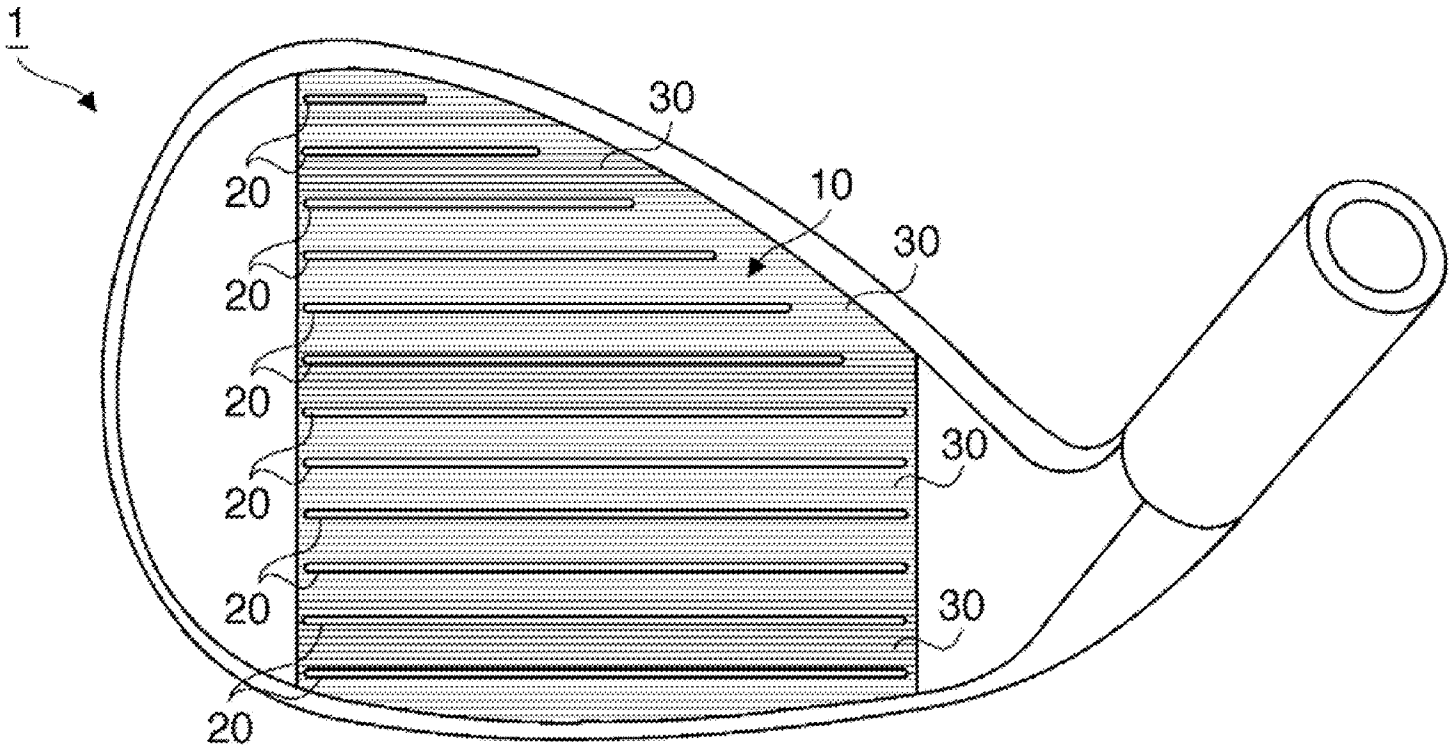
FIG. 1 is a view showing the outer appearance of a golf club head 1 according an embodiment of the present invention.

FIG. 1 is a view showing the outer appearance of a golf club head 1 according to an embodiment of the present invention. FIG. 1 shows an example in which the present invention is applied to an iron golf club head. The present invention is suitable for iron golf club heads, and particularly for middle iron golf club heads, short iron golf club heads, and wedge golf club heads. More specifically, the present invention is suitable for golf club heads with loft angles of 30° to 70° (both inclusive) and head weights of 240 g to 320 g (both inclusive). However, the present invention is also applicable to wood or utility (hybrid) golf club heads.

Figure 2:
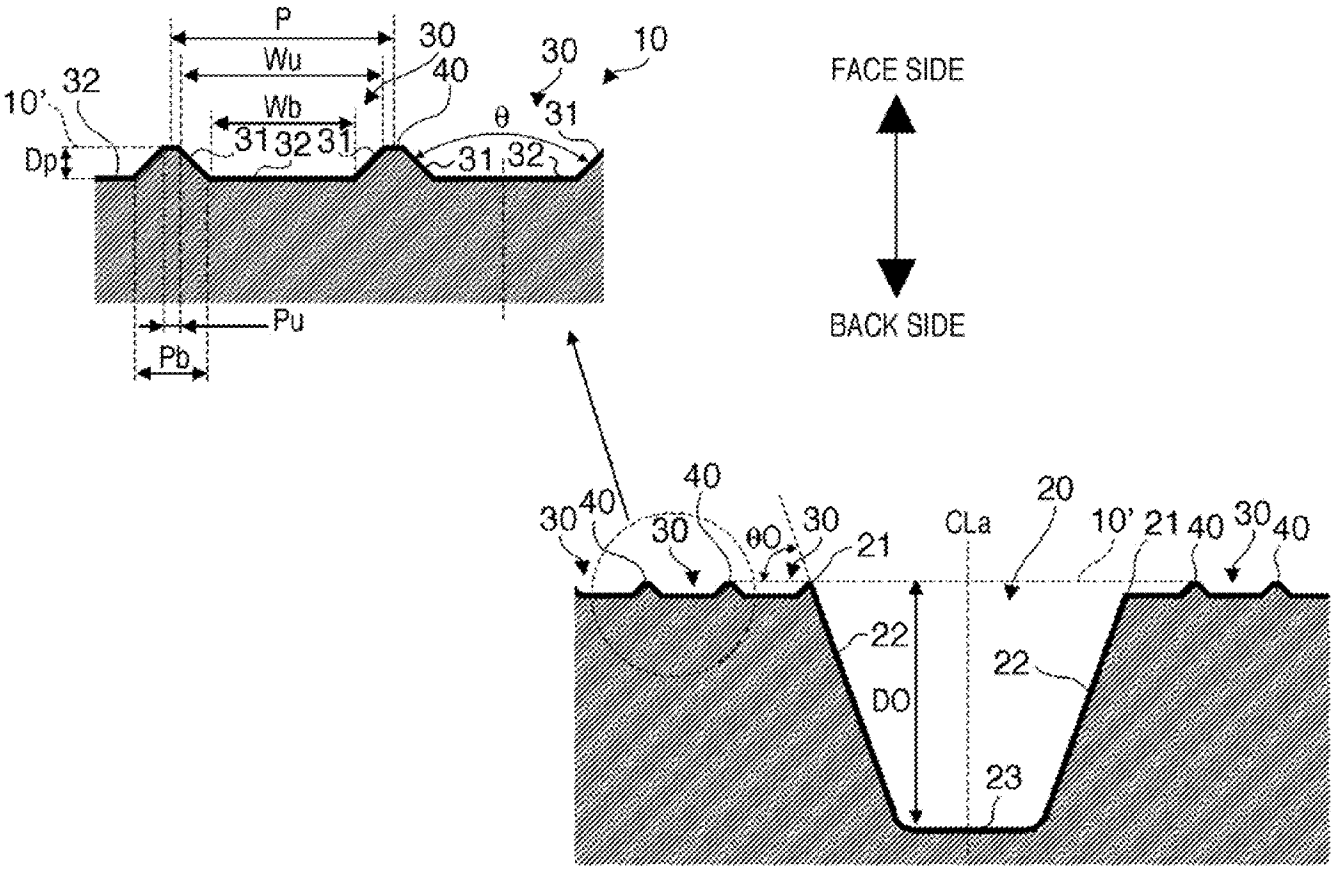
FIG. 2 shows a sectional view of a score line 20 and striations 30 in a direction perpendicular to the longitudinal direction (toe-and-heel direction), and an enlarged sectional view of the striations 30.

The golf club head 1 has a plurality of score lines 20 formed on its face (hitting surface) 10. The respective score lines 20 are straight grooves extending in the toe-and-heel direction and parallel to each other. The golf club head 1 also has a plurality of striations 30 formed on the face 10. In this embodiment, the striations 30 are straight grooves parallel to the score lines 20 and extending in the toe-and-heel direction. However, they may be arcuate or elliptically arcuate grooves extending in the toe-and-heel direction. FIG. 2 shows a sectional view of the score line 20 and striations 30 in a direction perpendicular to the longitudinal direction (toe-and-heel direction), and an enlarged sectional view of the striations 30. In FIG. 2, a dashed line 10' represents a virtual line on the same plane as the face 10. The score lines 20 will be described first.

In this embodiment, the cross-sectional shapes of the score lines 20 are the same except in two end portions in the longitudinal direction. The score lines 20 have the same cross-sectional shape. In addition, in this embodiment, the cross-sectional shape of the score line 20 is symmetric with regard to a virtual center line CLa in the width direction. The virtual center line CLa is perpendicular to the face 10 and passes the middle point of a width W of the score line 20. In this embodiment, the cross-sectional shape of the score line 20 is a trapezoid, but it may be another shape such as a V-shape.

The score line 20 has a pair of side surfaces 22 and a bottom surface 23. An edge 21 of the score line 20 is the boundary portion of the side surface 22 and face 10. The edge 21 may be rounded. An angle θ0 is the angle between the side surface 22 and face 10. The larger the angle θ0, the higher the backspin amount of a shot. The bottom surface 23 is parallel to the face 10. A depth D0 is the length from the face 10 to the bottom surface 23 as the deepest portion of the score line 20. In the case of a golf club head for competitions, the depth D0 must be 0.020 inches (0.508 mm) or less according to the rules.

Figure 3:
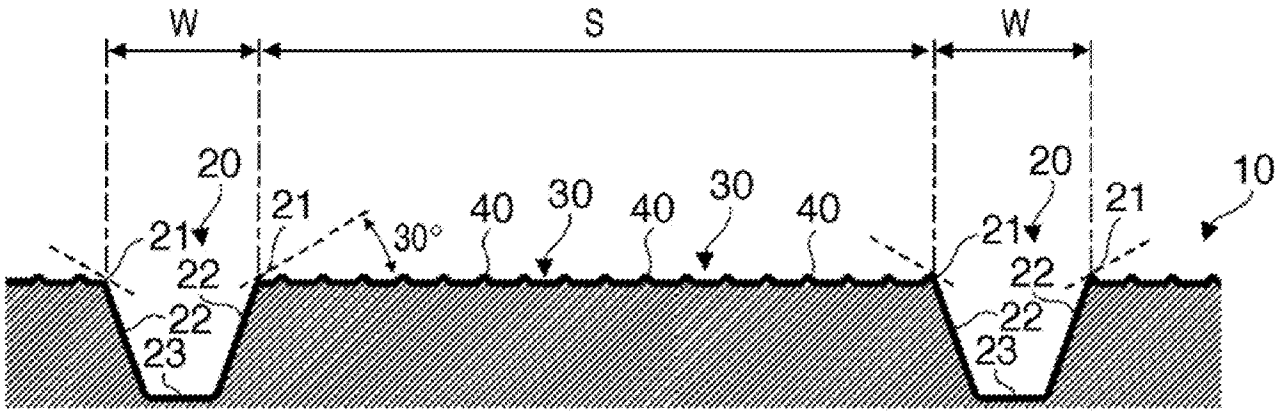
FIG. 3 is a view for explaining a width W of the score line 20 based on the 30 degrees measurement rule and a distance S between the score lines 20.

FIG. 3 is a view for explaining the width W of the score line 20 based on the 30 degrees measurement rule and a distance S between the score lines 20. The width W indicates the width measured based on the so-called 30-degree measurement method as a rule for a golf club for competitions. That is, the width W indicates the distance between the contact points of the respective virtual lines with an angle of 30° with respect to the face 10 and the respective edges 21 of the score line 20. The distance S between the score lines 20 indicates the distance between the contact points of the respective virtual lines with an angle of 30° with respect to the face 10 and the respective edges 21 of the score lines 20 adjacent to one another.

For a golf club head for competitions, the cross-sectional area, width W, and distance S of the score line 20 need to satisfy a cross section area A ($inch^2$)/(W (inch)+S (inch)) ≦0.003 (to be referred to as the area rule, hereinafter). The metric system expresses the cross section area A ($mm^2$)/(W (mm)+S (mm))≦0.0762. In order to make the golf club head 1 as a golf club head for competitions, it is designed to satisfy the area rule.

As a rule about score lines of a golf club head for competitions, in addition to the area rule, each edge of a score line must be positioned within a virtual circle with a radius of 0.011 inches concentric with a virtual circle with a radius of 0.010 inches which internally touches the side surface of the score line and the face (to be referred to as a two-circle rule, hereinafter).

In order to satisfy the two-circle rule, however, it is necessary to decrease the angle (the angle θ0 described above) between each side surface of the score lines and the face. In this case, not only a decrease in backspin amount but also a decrease in the volume of the score line occurs. Accordingly, a backspin amount may significantly decrease in the case of a shot from the rough or a shot on a rainy day.

Figure 4:
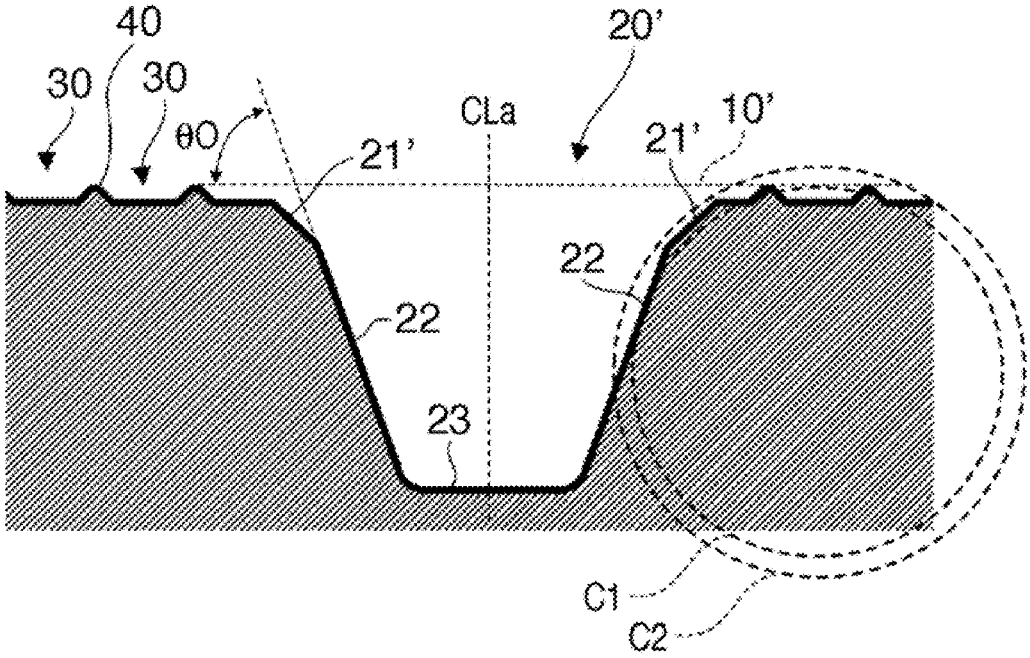
FIG. 4 is a view showing another example (score line 20') of the score line 20.

FIG. 4 is a view showing another example (score line 20') of the score line 20. The same parts as in the score line 20 are denoted by the same reference numerals in the score line 20', and the description thereof will not be repeated. Only the parts different from the score line 20 will be described.

In FIG. 4, a virtual circle C1 is a circle with a radius of 0.010 inches which internally touches the side surface 22 and face 10. A virtual circle C2 is a circle with a radius of 0.011 inches which is concentric with the virtual circle C1. In order to conform to the two-circle rule described above, the edge of the score line needs to be positioned within the virtual circle C2.

In the score line 20', a flat surface 21' is formed in an edge portion to satisfy the two-circle rule. Note that the shape of the edge may be a rounding or notch other than the flat surface 21'. In order to make the golf club head 1 as a golf club head for competitions, it is designed to satisfy the two-circle rule as well.

The striations 30 will be described next with reference to FIG. 2. In this embodiment, a plurality of the striations 30 is arranged at an equal pitch in a direction (a direction perpendicular to the longitudinal direction of the score line 20) perpendicular to the longitudinal direction of the striation 30. However, the striations 30 need not be arranged at an equal pitch.

The striation 30 has a pair of side surfaces 31 and a bottom surface 32. The cross-sectional shape of the striation 30 is symmetric with regard to a virtual center line CLb in the width direction. The cross-sectional shape of the striation 30 is an isosceles trapezoid having an upper base (a width Wu) at the face 10 side and a lower base (a width Wb) at the back side of the golf club head 1, in which the width Wu>the width Wb. The cross-sectional shapes of the striations 20 are the same except in two end portions in the longitudinal direction. An angle θ is the angle formed by a pair of the side surfaces 31. A depth Dp is the length from the face 10 (virtual line 10') to the bottom surface 32.

As a result of formation of the striations 30, protrusions 40 are formed between the striations 30 on the face 10. The protrusion 40 has a bottom portion with a width Pb and a top portion (top surface) with a width Pu, in which the width Pb<the width Wb. The cross-sectional shape of the protrusion 40 changes depending on the specifications of the striations 30, and is an isosceles trapezoid as shown in FIG. 2 or a triangle (Pu≈0). A pitch P indicates the arrangement interval of the protrusions 40, and has the same definition as the pitch of the striations 30.

The protrusions 40 catch a ball surface at impact, thereby providing a backspin to the ball. In this manner, in this embodiment, it is possible to increase the backspin amount of a shot by the protrusions 40 (striations 30) in addition to the score lines 20.

In this embodiment, the cross-sectional shape of the striation 30 is formed to be an isosceles trapezoid that satisfies the width Wu of the upper base>the width Wb of the lower base. With this arrangement, grass or the like is not easily caught in the striations 30, and grass or the like in the striations 30 readily comes out. Accordingly, it is possible to prevent the striations 30 from clogging with fine pieces of grass or the like. In addition, since the bottom surface 32 of the striation 30 is widely formed so as to satisfy the width Pb<the width Wb, it is possible to further prevent the striations 30 from clogging with fine pieces of grass or the like.

When the depth Dp is too small, the effect of increasing the backspin amount decreases. For this reason, the depth Dp needs to be 10 μm or more. On the other hand, the larger the depth Dp, the more easily the protrusion 40 catches a ball surface, but a ball surface is easily damaged when the depth Dp is too large. For this reason, the depth Dp is set to be 40 μm or less. Accordingly, the depth Dp satisfies 10 μm≦Dp≦40 μm. Note that for a golf club head for competitions, the surface roughness of the face is determined to be 25 μm or less at a maximum height (Ry) by the rule. Therefore, in order to make the golf club head 1 as a golf club head for competitions, the depth Dp is set to satisfy 10 μm≦Dp≦25 μm.

When the width Pu of the top portion of the protrusion 40 is too large, the effect of increasing the backspin amount decreases. Accordingly, the depth Pu is preferably set to 10 μm or less. The smaller the width Pu, the more easily the protrusion 40 catches a ball surface, and the effect of increasing the backspin amount can increase. Accordingly, the width Pu preferably satisfies 0 μm<Pu≦15 μm.

The striations 30 and protrusions 40 influence the arithmetic mean roughness (Ra) of the face 10. The larger the surface roughness of the face 10, the more the backspin amount increases, but a ball surface is easily damaged. Accordingly, the surface roughness of a portion of the face 10 with the striations 30 is preferably 1.0 μm to 5.0 μm (both inclusive) in arithmetic means roughness (Ra), and more preferably 1.5 μm or more. Note that for a golf club head for competitions, the surface roughness of the face is determined to be 4.57 μm or less in arithmetic mean roughness (Ra) by the rules. Therefore, in order to make the golf club head 1 as a golf club head for competitions, it is designed such that the arithmetic means roughness (Ra) of the face 10 is 4.57 μm or less.

When the angle θ is too small, the protrusion 40 becomes too thin and wears out quickly. Accordingly, the angle θ is preferably 30° or more. The larger the angle θ, the less easily the protrusion 40 catches a ball surface, and the effect of increasing the backspin amount decreases. Accordingly, the angle θ is preferably 140° or less.

The smaller the pitch P, the more easily the striations 30 clog with fine pieces of grass or the like, and the protrusions 40 do not easily catch a ball surface. Accordingly, the pitch P is preferably 100 μm or more. On the other hand, when the pitch P is too large, the number of protrusions 40 that catch a ball surface decreases, and therefore the effect of increasing the backspin amount decreases. Accordingly, the pitch P is preferably 600 μm or less.

Figure 5A:
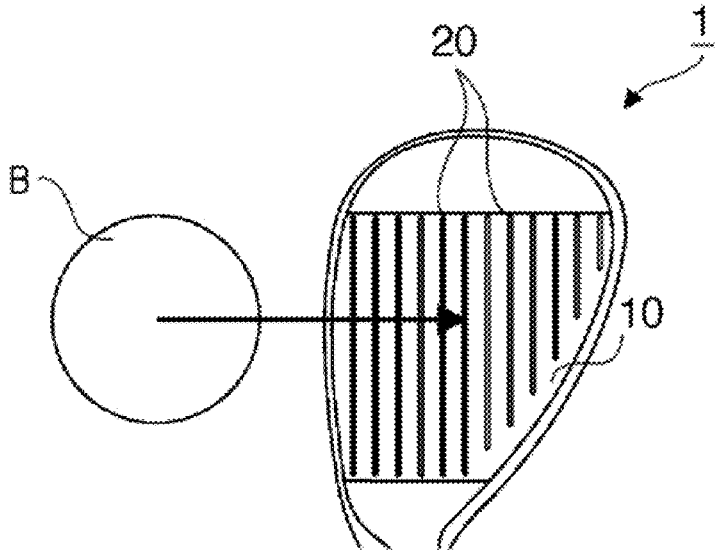
FIG. 5A is a view showing a case in which a face 10 is directed perpendicularly to the target direction.
Figure 5B:
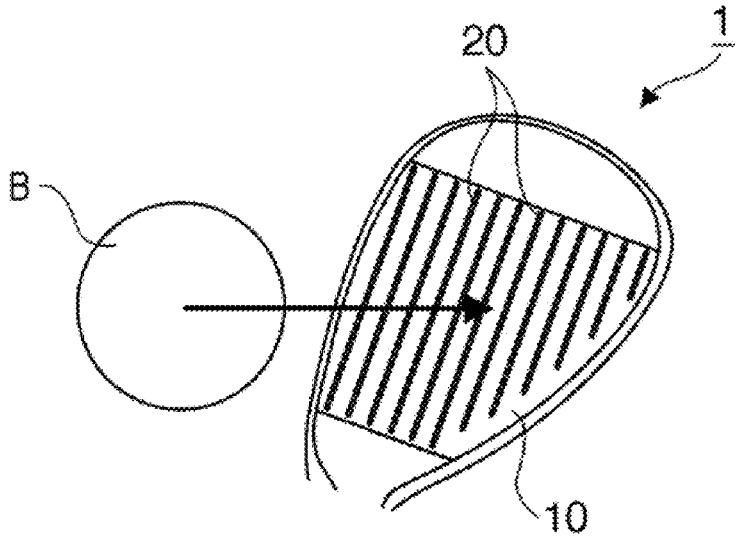
FIG. 5B is a view showing a case in which the face 10 is open.

When using a short iron or wedge, a player sometimes hits a golf ball with the face open so that backspin is easily provided to the ball. FIG. 5A shows a case in which the face 10 is directed perpendicularly to the target direction, and FIG. 5B shows a case in which the face 10 is open. Note that the striations 30 are not shown in FIGS. 5A and 5B. In each of FIGS. 5A and 5B, the arrow represents the relative displacement direction of a golf ball B with respect to the face 10 at impact.

When the face 10 is open as shown in FIG. 5B, the golf ball B slides on the face 10 such that it diagonally crosses the score lines 20 and striations 30 at impact. When the direction (i.e., the arrangement direction) perpendicular to the longitudinal direction of the striations 30 is more parallel to the direction indicated by the arrow in FIG. 5B, the number of the striations 40 that catch the surface of the golf ball B increases and backspin is easily provided to the golf ball B. For this reason, the striations 30 may be formed not to be parallel to the score lines 20 but to intersect them.

Figure 6:
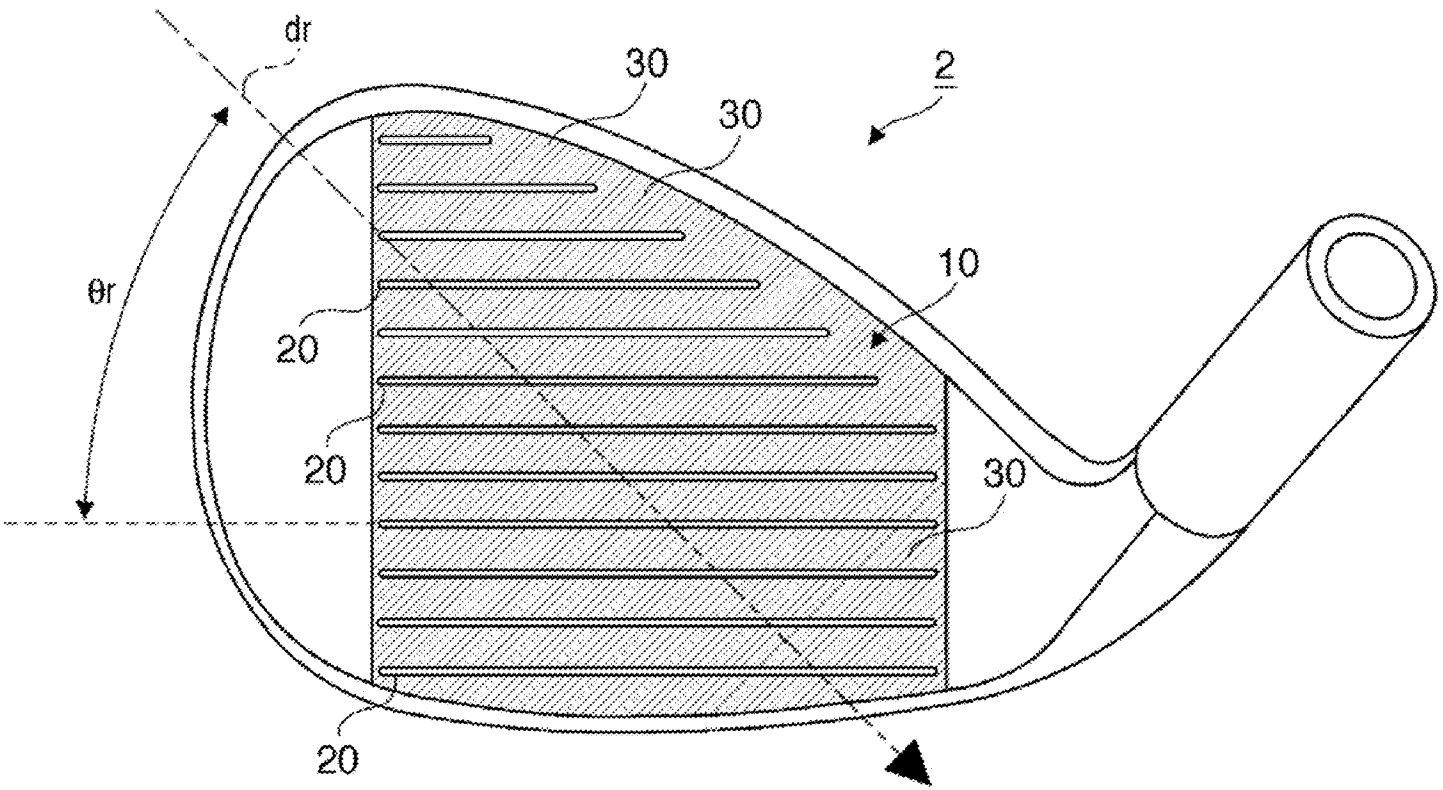
FIG. 6 is a view showing the outer appearance of a golf club head 2 in which striations 30 intersect score lines 20.

FIG. 6 is a view showing the outer appearance of a golf club head 2 in which striations 30 intersect score lines 20. The golf club head 2 is different from the golf club head 1 only in an arrangement direction dr of the striations 30. In the example shown in FIG. 6, an angle θr between the arrangement direction dr and the longitudinal direction of the score line 20 is about 45° in the clockwise direction from the toe side of the score line 20. When the arrangement direction dr of the striations 30 is set as described above, the backspin amount of a shot with a face 10 open can be increased.

For example, the angle θr can be set within a range of 20° to 90° (both inclusive). For a short iron or wedge, since a player often hits a ball with the face 10 open, it is desirable to set the angle θr within a range of 40° to 70° (both inclusive).

Figure 7A:
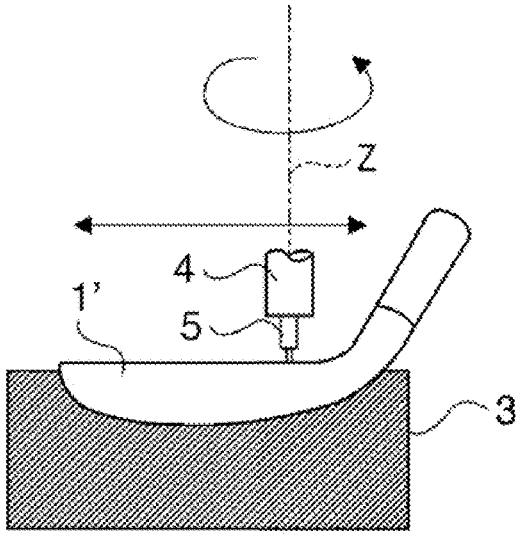
FIGS. 7A and 7B are views for explaining the method of forming the striations 30 by an NC milling machine.
Figure 7B:
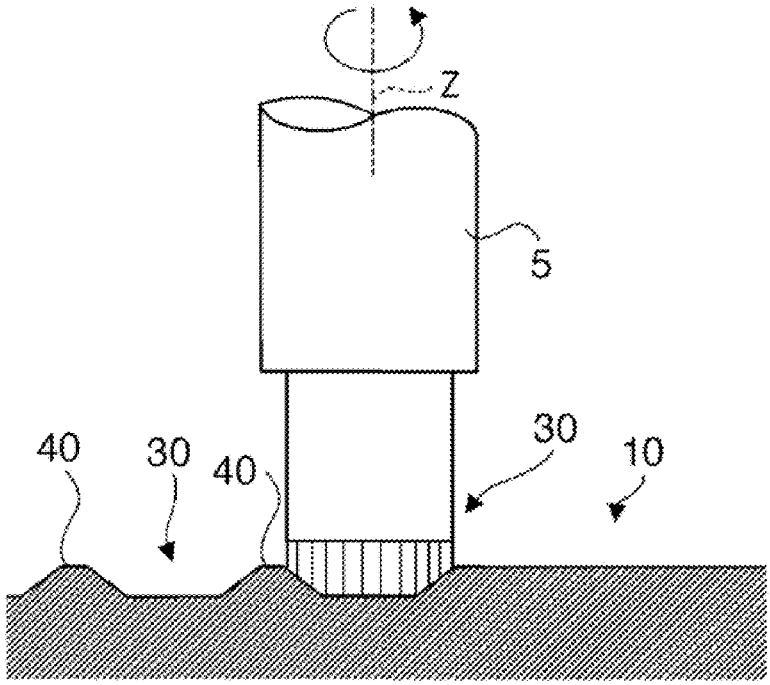

The method of forming the striations 30 will be described next. The striations 30 can be formed as cut traces by milling of the face 10. The striations 30 can be formed by milling by using, for example, an NC (numerically controlled) milling machine. FIGS. 7A and 7B are views for explaining the method of forming the striations 30 by an NC milling machine.

As shown in FIG. 7A, a golf club head 1' without the score lines 20 and striations 30 is fixed to the NC milling machine via a jig 3. Note that in this embodiment, a case in which the face 10 is integrally formed with the golf club head is described. However, a face member which forms the face 10 and the head body may be prepared as separate members and joined together. In this case, the face member is fixed to the NC milling machine to form the score lines 20 and striations 30.

The NC milling machine includes a spindle 4 which is rotatably driven around the axis Z. A cutting tool (end mill) 5 is attached to the lower end of the spindle 4. The distal shape of the cutting tool 5 is selected depending on the cross-sectional shape of the striation 30. As shown in FIG. 7B, the cutting tool 5 having an isosceles trapezoidal shape can form one striation 30 without reciprocating the cutting tool 5.

After setting the plane coordinates of the face 10 in the NC milling machine, the spindle 4 is rotatably driven. The face 10 (golf club head 1') or cutting tool 5 is moved relatively in the formation direction of the striations 30 to cut the face 10. When one striation 30 has been formed, the cutting tool 5 is separated from the face 10. After that, the cutting tool 5 is moved relatively in the arrangement direction of the striations 30, and the next striation 30 is formed. In this manner, the striations 30 are sequentially formed. When all the striations 30 are formed, the cutting tool 5 is changed to form the score lines 20.

Note that as the method of forming the score lines 20 and striations 30, forming methods other than milling such as electrical discharge machining, casting, or the like can be employed.

When the striations 30 are formed on the face 10, since the surface hardness of the face 10 decreases, the face 10 may be easily worn out. For this reason, it is preferable to perform surface treatment for increasing the hardness of the face 10 after forming the striations 30. As such surface treatment, cementing, nitriding, soft nitriding, PVD (Physical Vepor Deposition), ion plating, DLC (Diamond Like Carbon) treatment, plating, or the like is available. Particularly, surface treatment such as cementing or nitriding is preferable which reforms a surface without forming another metal layer on it.

EXAMPLES

Golf club heads #1 to #4 and #11 to #24 that were different in the specifications of striations were fabricated, and the backspin amounts and degrees of clogging of striations were evaluated using golf clubs respectively mounted with those golf club heads. FIG. 8 is a table showing the specifications of striations of golf club heads #1 to #4 and #11 to #24, the evaluation results of the backspin amounts and degrees of clogging of striations, and the rule conformance associated with the surface roughness of the face.

All golf club heads #1 to #4 and #11 to #24 were sand wedges that were different only in the specifications of striations. A plurality of striations was formed parallel to score lines, like the golf club head 1 in FIG. 1.

In FIG. 8, "shape of striation" means the cross-sectional shape of a striation. Only in golf club head #1, the cross-sectional shape of the striation is rectangular, and in each of other golf club heads, the cross-sectional shape of the striation is an isosceles trapezoid as shown in FIG. 2.

"Wb/Pb" corresponds to the ratio of the width Wb of the lower base of the striation 30 and the width Pb of the bottom portion of a protrusion shown in FIG. 2. When Wb/Pb is smaller than 1, the width Pb is larger than the width Wb. When Wb/Pb is larger than 1, the width Wb is larger than the width Pb. In each of golf club heads #2 to #4, the width Pb is larger than the width Wb. "Pu" corresponds to the width Pu of the top portion of the protrusion 40 shown in FIG. 2. "θ" corresponds to the angle formed by a pair of the side surfaces 32 of the striation 30 shown in FIG. 2. "Dp" corresponds to the depth Dp of the striation 30 shown in FIG. 2. "P" corresponds to the pitch P of the protrusions 40 shown in FIG. 2. These are all set values. "Surface roughness (Ra)" indicates the arithmetic mean roughness of the face and shows actually measured values.

The backspin amounts and the degrees of clogging of striations were evaluated by hitting a plurality of golf balls with each of the golf clubs from the rough about 30 yards away from the green. "Spin amount" in FIG. 8 was evaluated in four levels (A to D) by observing how readily the ball stopped on the green. Level A means that the ball was most readily stopped, that is, the backspin amount was the highest. "Degree of clogging" was evaluated by visually observing the degree of clogging of the striations after the test, and evaluated in three levels (A to D). Level A means that clogging was the least. In "rule conformance", a golf club head with arithmetic mean roughness (Ra) of 4.57 μm or less and a maximum height (Ry) of 25 μm or less is indicated by (○) meaning "conform", and otherwise indicated by (X) meaning "not conform".

From the comparison between golf club heads #1 and #11, it is obvious that when the cross-sectional shape of each of the striations is an isosceles trapezoid, clogging of striations is less. Although the degrees of clogging are C and D in golf club heads #2 to #4, the degrees of clogging are A to C in golf club heads #11 to #24. Accordingly, it is obvious that clogging of striations is less when the width Wb is larger than the width Pb.

From the comparison between golf club heads #11 to #14 having the same pitch P, it is obvious that the higher backspin amount can be obtained when the width Pu is smaller. Since a certain backspin amount was obtained in golf club head #14, the width Pu is preferably 15 μm or less.

From the comparison between golf club heads #15 to #18 and #20 having the same pitch P and the same depth Dp, it is obvious that clogging of striations is less when the angle θ is larger. Since a certain backspin amount was obtained in golf club head #15 but a backspin amount obtained in golf club head #18 was not very high, the angle θ is preferably between 30° to 140° (both inclusive).

From the comparison between golf club heads #19 to #21, it is obvious that the higher backspin amount can be obtained when the depth Dp is larger. Since a certain backspin amount was obtained in golf club head #20 but a lowest backspin amount was obtained in golf club head #19, the depth Dp needs to be 10 μm or more. On the other hand, in golf club head #21, the backspin amount was high but some flaws were identified on the ball surface from visual observation. Accordingly, from the viewpoint of how easily a ball is damaged, the depth Dp needs to be 40 μm or less. Note that as described above, for a golf club head for competitions, the surface roughness of the face is determined to be 25 μm or less at a maximum height (Ry) by the rule. Therefore, in order to make a golf club head for competitions, the depth Dp is set to satisfy 10 μm≦Dp≦25 μm.

From the comparison between golf club heads #22 to #24, it is obvious that clogging of striation is less when the pitch P is larger. Since a certain backspin amount was obtained in golf club head #25, the pitch P is preferably 600 μm or less. On the other hand, since there was a certain degree of clogging of striations in golf club head #22, the pitch P is preferably 100 μm or more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-262060, filed Oct. 8, 2008, which is hereby incorporated by reference herein in its entirety.

What is claimed is:

1. A golf club head including a plurality of score lines on a face, comprising a plurality of striations formed on said face and extending from a toe side to a heel side, wherein a depth Dp of each striation satisfies:

$$10\ \mu m \leqq D \leqq 40\ \mu m,$$

a cross-sectional shape of each striation is a isosceles trapezoid having an upper base at the face side and a lower base at a back side of the golf club head, the upper base and lower base satisfy:

the upper base>the lower base, and a width Pb of each protrusion formed between the striations and a width Wb of the lower base satisfies:

$$Pb < Wb.$$

2. The golf club head according to claim 1, wherein a width Pu of an upper portion of each protrusion satisfy:

$$0 < D \leqq 15\ \mu m.$$

3. The golf club head according to claim 1, wherein a surface roughness of a region in said face with said striations satisfies in the arithmetic mean deviation of the profile Ra, $$1.0\ \mu m \leqq Ra \leqq 5.0\ \mu m.$$

4. The golf club head according to claim 1, wherein an angle θ between side surfaces of striations adjacent to one another satisfies:

$$30\ \text{degrees} \leqq \theta \leqq 140\ \text{degrees}.$$

5. The golf club head according to claim 1, wherein a pitch P between the protrusions satisfies:

$$100\ \mu m \leqq P \leqq 600\ \mu m.$$

6. The golf club head according to claim 1, wherein a cross section area A ($inch^2$) of said score line, a width W (inch) of said score line measured based on the 30 degrees measurement rule and a distance S (inch) between said score lines adjacent one another satisfy:

$$A/(W+S) \leqq 0.003, \text{ and}$$

edges of said score lines are formed to be positioned within a second virtual circle with a radius of 0.011 inches, the second virtual circle being concentric with a first virtual circle which internally touches said side surface and said face with a radius of 0.010 inches.

* * * * *